US007337862B1

(12) United States Patent
Greenley et al.

(10) Patent No.: US 7,337,862 B1
(45) Date of Patent: Mar. 4, 2008

(54) MONO-WHEEL VEHICLE WITH TILT MECHANISM

(75) Inventors: Peter Greenley, Chicago, IL (US); Jeffrey Rehkemper, Chicago, IL (US)

(73) Assignee: Rehco, LLC, Chicago, IL (US)

( * ) Notice: Subject to any disclaimer, the term of this patent is extended or adjusted under 35 U.S.C. 154(b) by 365 days.

(21) Appl. No.: 11/144,997

(22) Filed: Jun. 3, 2005

(51) Int. Cl.
*A63G 25/00* (2006.01)

(52) U.S. Cl. ..... 180/10; 180/21; 280/205; 280/206

(58) Field of Classification Search ..... 180/10, 180/21; 280/205, 206
See application file for complete search history.

(56) References Cited

U.S. PATENT DOCUMENTS

| | | | | | |
|---|---|---|---|---|---|
| 325,548 | A | * | 9/1885 | Lose | 280/207 |
| 1,915,886 | A | * | 6/1933 | Gutierrez | 180/10 |
| 2,549,182 | A | * | 4/1951 | Ekenstam | 404/130 |
| 3,260,324 | A | * | 7/1966 | Suarez | 180/10 |
| 3,762,744 | A | * | 10/1973 | Sidlauskas | 280/207 |
| 3,777,835 | A | * | 12/1973 | Bourne | 180/10 |
| 4,045,096 | A | | 8/1977 | Lidov | |
| 4,241,931 | A | * | 12/1980 | Healy | 280/205 |
| 4,324,413 | A | * | 4/1982 | Bensette et al. | 280/205 |
| 4,501,434 | A | * | 2/1985 | Dupuis | 280/206 |
| 4,537,269 | A | * | 8/1985 | Fisher | 180/10 |
| 5,064,210 | A | * | 11/1991 | Gibbons | 280/206 |
| 6,651,766 | B2 | * | 11/2003 | Kamen et al. | 180/218 |

OTHER PUBLICATIONS

Author N/A, Monowheels. The Story of Vehicles with Insufficient Wheels, (Webink), last updated May 24, 2005, pp. 1-48.
Author N/A, The Wheelsurf—calling all thrillseekers, Gizmag (magazine/website), Feb. 2005, pp. 1-3.
S.Tsai, E.Ferreira, C.Paredis, Control of the Gryrover, Proceedings of the IEEE/RSJ International Conference on Intelligent Robots and Systems, vol. 1, Oct. 1999, pp. 179-184.

* cited by examiner

*Primary Examiner*—Paul N. Dickson
*Assistant Examiner*—Marlon Arce-Diaz

(57) ABSTRACT

In accordance with the present invention a mono-wheel vehicle is provided. The vehicle includes a housing with an inner circumference. A wheel is connected to the housing such that the wheel is able to rotate independently of the housing. The wheel has an outside portion that makes contact with a surface. A motor mechanism is provided for rotation of the wheel. Gyroscopic forces acting on the rotating wheel maintain the vehicle in a substantially upright position such that the vehicle is able to travel along the surface in a first direction. A platform connected to the inner circumference of the housing is pivotable in relation to the housing to causes a change in a center of gravity. The change in center of gravity causes the gyroscopic forces acting on the vehicle to turn the vehicle towards the changing center of gravity in order to maintain the vehicle in a more upright position.

23 Claims, 4 Drawing Sheets

MONO-WHEEL VEHICLE WITH TILT MECHANISM

FIELD OF THE INVENTION

The present invention relates to a mono-wheel vehicle with a tilt mechanism that causes a rotating wheel in contact with a surface to turn.

BACKGROUND OF THE INVENTION

The concept and design of mono-wheel vehicles has intrigued designers and engineers since the early 1860's. The concepts and designs have typically been full size vehicles for human transportation. Mono-wheel vehicles have one large wheel with a rider and engine (if any) inside its circumference. Mono-wheel vehicles depend on a gyroscopic effect to keep them upright. However, when mono-wheel vehicles are designed for human transportation, great care must be taken to ensure that the rider is stationary and does not move relative to the movement or momentum of the rotating wheel. To accomplish this, complex steering, stability, and components are needed which increases the cost of the devices to an extent that the general public is unable to enjoy the same.

One example of a remote controlled unmanned mono-wheel vehicle is the Gyrover II designed at Carnegie Mellon University. The Gyrover II is a highly complex robotic vehicle that uses an internal gyroscope nominally aligned with the wheel and spinning in the direction of forward motion to create stability. The Gyrover II's angular momentum produces lateral stability when the wheel is stopped or moving slowly. A tilt mechanism is used to tilt the internal gyroscope's axis about the fore/aft (roll) axis with respect to the wheel. Because the internal gyroscope acts as an inertial reference, the principal effect of the tilt action is to cause the wheel to steer in the direction of leaning. Torques generated by a drive motor react against the internal gyroscope, which hangs as pendulum from the wheel's axle. The torques produce thrust for accelerating and braking the Gyrover II.

As one can appreciate from the prior art, prior mono-wheeled vehicles are extremely complex and expensive machines. These vehicles are not practical for the enjoyment of the general public. To provide a mono-wheel vehicle suitable for the general public it must be durable, inexpensive, practical to manufacture, and capable of being operated by adults and children.

This invention solves the problems of stability and performance to provide a durable and efficient radio controlled mono-wheel with a simplistic design that is cost feasible for mainstream consumers.

SUMMARY OF THE INVENTION

In accordance with the present invention a mono-wheel vehicle is provided. The vehicle includes a housing. The housing has an inner circumference. A wheel is connected to the housing such that the wheel is able to rotate independently of the housing. The wheel also has an outside portion that makes contact with a surface. The vehicle also includes a means for rotating the wheel. Gyroscopic forces acting on the rotating wheel maintain the vehicle in a substantially upright position such that the vehicle is able to travel along the surface in a first direction. The vehicle also includes a platform connected to the inner circumference of the housing. A pivoting means is provided to pivot the platform in relation to the housing which when pivoting causes a change in a center of gravity. The change in center of gravity causes the gyroscopic forces acting on the vehicle to turn the vehicle towards the changing center of gravity in order to maintain the vehicle in a more upright position.

The vehicle also includes a tilt mechanism secured between the housing and the platform. Preferably the tilt mechanism includes a servo. The vehicle is also remotely controlled.

Other aspects of the invention include the wheel having two sides with a rim extending outwardly from each side. In combination with the housing having a plurality of bearings to capture the rims, such that the wheel is rotatably secured within the housing. Also, the vehicle may have a motor secured within the housing to drive a gear meshed to an annular rack defined on the wheel.

Another aspect of the invention is that the outer portion of the wheel may differ to create different driving characteristics.

Numerous other advantages and features of the invention will become readily apparent from the following detailed description of the invention and the embodiments thereof, from the claims, and from the accompanying drawings.

BRIEF DESCRIPTION OF THE DRAWINGS

A fuller understanding of the foregoing may be had by reference to the accompanying drawings, wherein.

DETAILED DESCRIPTION OF THE EMBODIMENTS

Figure 1:
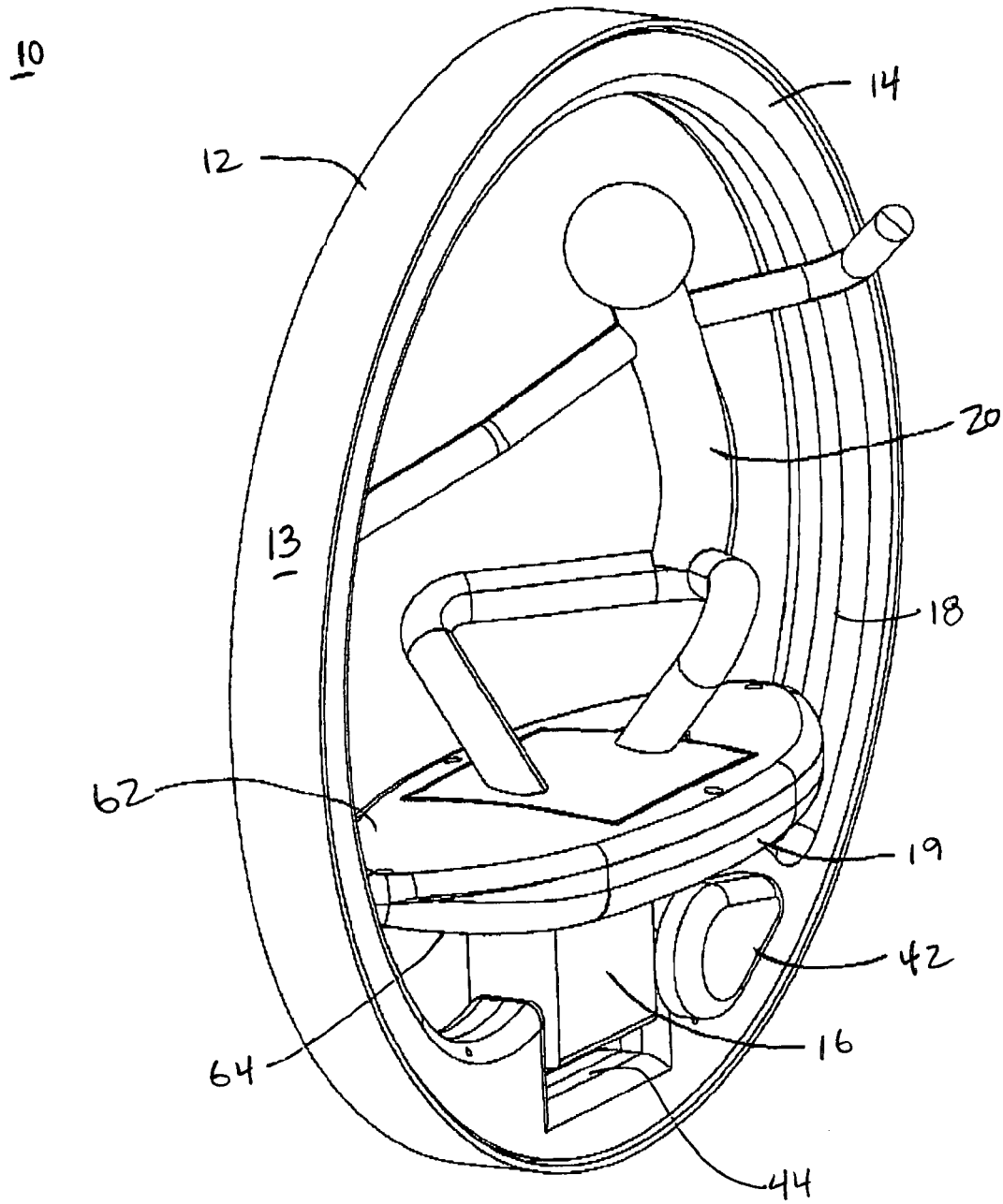
FIG. 1 is a perspective view of a mono-wheel vehicle in accordance with the present invention.

While the invention is susceptible to embodiments in many different forms, there are shown in the drawings and will be described herein, in detail, the preferred embodiments of the present invention. It should be understood, however, that the present disclosure is to be considered an exemplification of the principles of the invention and is not intended to limit the spirit or scope of the invention and/or claims to the embodiments illustrated.

Referring now to FIG. 1, there is shown a mono-wheel vehicle 10. The vehicle 10 includes a wheel 12 rotatably secured with a housing 14. A tilt mechanism 16 is pivotably secured within the inner circumference 18 defined by the housing 14. The tilt mechanism 16 has a platform 19 that is capable of supporting a character 20. The character 20 may be of any shape or size.

During operation, the wheel 12 rotates making contact with a surface to propel the vehicle 10. As the speed of the rotating wheel 12 increases, gyroscopic forces and the angular momentum of the wheel 12 keep the vehicle 10 upright. In addition, when the speed decreases, inertia of rotating wheel 12 also keeps the vehicle upright 10. To turn the vehicle 10, the user remotely pivots the tilt mechanism 16. The center of gravity of the tilt mechanism 16, the platform 19 and/or the character 20, will shift with the pivoting tilt mechanism 16. The shifting of the center of gravity towards one side will add a torque to the angular momentum defined in the moving vehicle 10, causing the vehicle 10 to lean towards (or turn) into the side of the center of gravity shift. This is done in order to maintain and conserve the angular momentum of the vehicle 10.

The speed of the wheel 12 is controlled with a remote control unit (not shown). The remote control unit also controls the degree of pivoting of the tilt mechanism 16. It should be appreciated that the higher degree of pivoting the sharper the turn. The remote control unit may use infra red, radio waves, optical sensors or other well known communication means.

Figure 2:
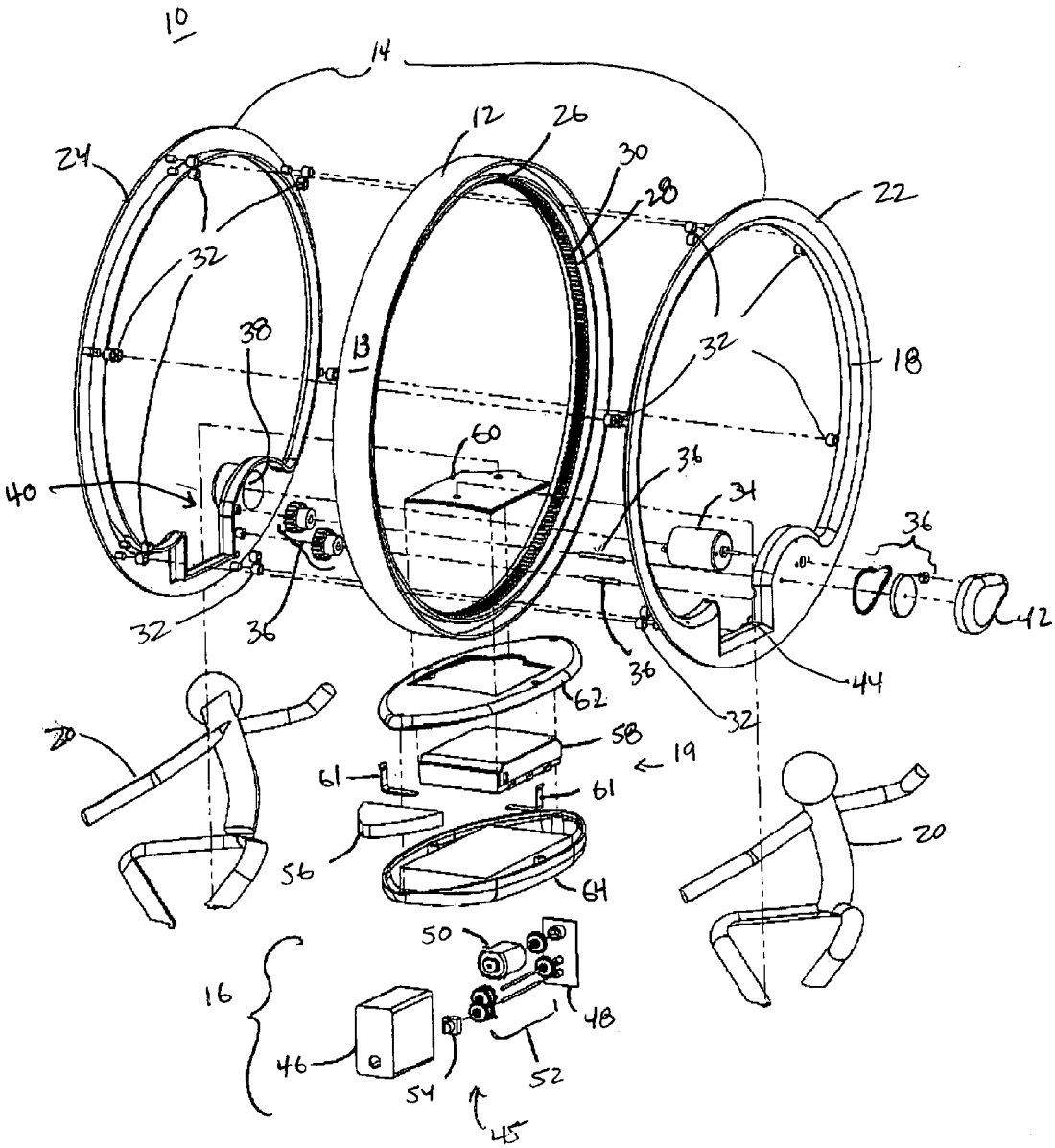
FIG. 2 is an exploded view of FIG. 1.
Figure 3A:
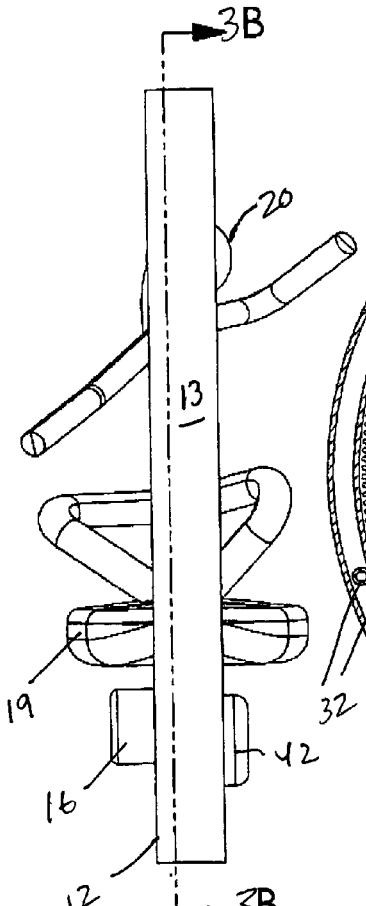
FIG. 3*a* is a front view of FIG. 1.
Figure 3B:
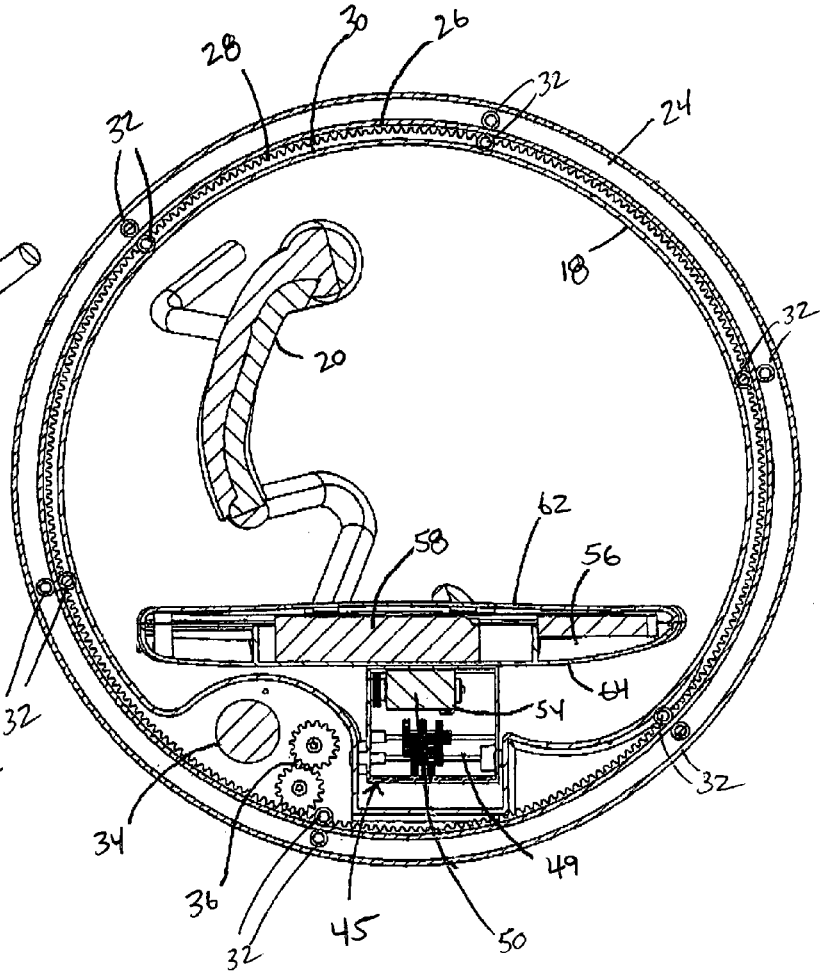
FIG. 3*b* is a sectional view of FIG. 1 taken through line 3*b*.

Referring now to FIGS. 2 and 3, the wheel 12 of the vehicle 10 is flat on the outer circumference to enable the vehicle to stand in a vertical position (when not moving) without support from an outside source. The wheel 12 is rotatably secured within a two piece housing 22 and 24 such that the wheel 12 is able to spin while the housing 14 remains in a constant position.

The means to rotatably support the wheel 12 within the housing 14 is defined as providing the wheel 12 with a rim 26 extending outwardly from each side of the wheel 12. A gear rack 28 is located about an inner circumference 30 defined by the wheel 12. The rim 26 sits within a plurality of bearing pairs 32 attached around each piece of the housing 22 and 24. A first motor 34 secured within the housing 14 drives a gear train 36 that is meshed to the rack 28. The first motor 34 sits in a motor housing section 38 defined by a lower portion 40 of the housing 14. A cap 42 secures the motor housing section 38 and other motor components such as pulleys and/or axles. When the first motor 34 is operating, the gear train 36 rotates thus driving the wheel 12, which may be driven in either a forward or backward direction.

Figure 4:
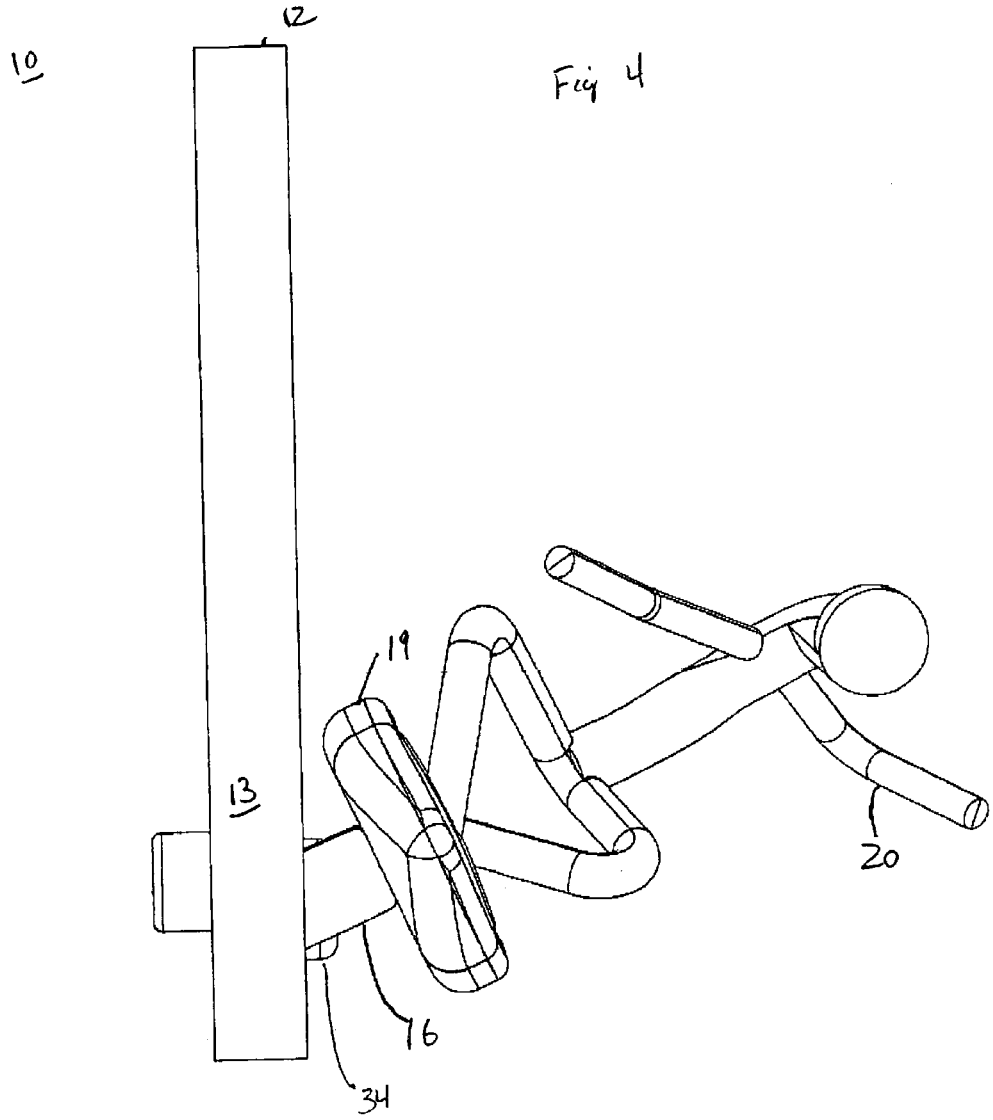
FIG. 4 is a front view of FIG. 1 illustrating the tilt mechanism leaning to one side.

Referring now to FIGS. 2 through 4, as explained above turning of the vehicle is accomplished through the leaning of the tilt mechanism 16. The tilt mechanism 16 is pivotally secured to an inner circumference 18 of the housing 14. As illustrated the housing 14 includes an aperture 44 on the inner circumference 18 sized to accommodate the tilt mechanism 16. The tilt mechanism 16 includes a servo 45 that is operably connected to the housing 14. The servo 45 acts to lean the tilt mechanism 16 when controlled by a remote controller unit (not shown).

The servo 45 includes a servo housing 46 secured to a servo back plate 48. The servo housing 46 and servo back plate 48 are pivotally connected on a servo axle 49 that is secured to the inner circumference 18. Within the servo housing 46 is a servo motor 50, which drives a servo gear train 52. The servo motor 50 drives the servo gear train 52 causing the tilt mechanism 16 to pivot on the servo axle 49 and thus causing the tilt mechanism 16 lean to one side or the other. Secured to the tilt mechanism 16 is the platform 19.

The tilt mechanism may also includes a variable resistor 54 that determines when the tilt mechanism is centered and determines the degree of tilt. The degree of tilt dictates the sharpness or softness of the turns. Other well known means to locate a center position and other tilt positions may be used.

The platform 19 provides the weight to influence the direction of the vehicle 10. The platform includes a PC board 56 with a receiver to receive signals from an remote control unit (not shown), battery pack 58, a battery door 60, battery contacts 61, a top portion 62 and a bottom portion 64. The top portion 62 and bottom portion 64 are assembled to form the platform 19 with the battery door 60 providing external access to replace the battery pack 58. The platform 19 can have any design or shape, subject to weight and size ratio based on the dimensions of the wheel 12 and the vehicle 10. In the embodiment shown, the platform 19 is shaped as a surfboard, and the character 20 is positioned and made to look like a surfer.

The signals received from the remote control unit control the motor in the vehicle and the motor in the tilting mechanism. Thus the speed of the vehicle and the turning of the vehicle may be remotely controlled. In another aspect the circuit board may include pre-programmed driving instructions such as turns, figure eights, slowing and stopping.

Operation of a remote control unit (not shown) will send a signal to the vehicle, which transfers the signals to the tilt mechanism 16. The tilt mechanism 16 will pivot causing the platform 19 to lean in a specified direction (left or right). The shift in the positioning of the platform 19 from the vertical to a leaning position (illustrated in FIGS. 3*a* to 4) shifts the center of gravity of the vehicle 10. As mentioned above, the shift in the center of gravity causes a change in the angular momentum which keeps the vehicle 10 traveling in a straight line. The vehicle 10 will thus turn into the lean to maintain a constant and straight angular momentum.

In addition to traditional directional movement, the vehicle 10 can perform numerous other maneuvers. Two examples are a movement from a horizontal to a vertical position, and a 360 degree rotation of the vehicle 10.

When the vehicle 10 is laying on its side in a horizontal position, tilt mechanism 16 can push the vehicle 10 back up into a vertical position. As the first motor 34 spins the wheel 12 faster and faster, the wheel 12 builds up an momentum. The user can then pivot the tilt mechanism 16 into the surface causing the vehicle to push against the surface and towards a more upright position. As the vehicle 10 moves to a more upright position, the tilt mechanism 16 pivots more towards an upright position. The changes in the center of gravity keeps adjusting the angular momentum of the vehicle 10 until the vehicle 10 rights itself to a standing position.

Further, since the vehicle is unmanned no additional components are needed to keep the platform 19 in a substantially horizontal position. Thus whenever the first motor 34 is not under power, the gear train 36 is static. If the vehicle 10 was previously moving, the angular momentum of the vehicle 10 will continue to rotate the wheel 12. However, since the gear train 36 is static, inertia of the vehicle causes the housing 14 to rotate along with the wheel 12. This produces a flipping effect of the tilt mechanism 16 and platform 19.

Another embodiment of the invention includes alternate wheel surfaces to replace the flat surface of the wheel 12 as described above. Different surfaces on the wheel 12 will change performance of the vehicle 10. For example, a rounded surface enables the vehicle to have more maneuverability and increased speed capabilities since it will have a smaller surface contact area. In addition, the outer surface of the wheel may have a low surface friction, this is unique because it permits the vehicle to travel at slow speeds without falling over. With a low surface friction, the wheel will have a tendency to slip on a surface. As such the wheel is able to spin initially at a higher rate with the vehicle moving slowly. With the wheel spinning faster the gyroscopic forces will still act on the vehicle to keep it upright at the slow moving speed. The low surface friction also permits the vehicle to turn when moving at the slower speeds because the gyroscopic forces are active.

It is also important to note that the embodiments disclosed herein cover a radio controlled mono-wheel vehicle, that utilizes the combination of one wheel and a tilt mechanism for movement where the one wheel is powered for forward and rearward movement and where the tilt mechanism adjusts the center of gravity of the vehicle to turn in the left and right directions. In addition, the vehicle's movement is radio controlled by a user. It should be further noted that while the embodiments disclose a flat surface and a rounded surface for the wheel, the present invention may also utilize other surfaces with different textures and shapes.

From the foregoing and as mentioned above, it will be observed that numerous variations and modifications may be effected without departing from the spirit and scope of the novel concept of the invention. It is to be understood that no limitation with respect to the specific methods and apparatus illustrated herein is intended or inferred. It is intended to cover by the appended claims all such modifications as fall within the scope of the claims.

We claim:

1. A mono-wheel vehicle comprising:

a housing having an inner circumference;

a wheel connected to the housing such that the wheel can rotate independently of said housing, said wheel having an outside portion that makes contact with a surface;

a means for rotating said wheel, wherein when said wheel is rotating, gyroscopic forces acting on the vehicle maintain said rotating wheel in a substantially upright position and traveling along the surface in a first direction;

a platform connected to the inner circumference of the housing;

a mechanically operated means for pivoting the platform to cause a change in a center of gravity, wherein the change in center of gravity causes the gyroscopic forces acting on the vehicle to turn the vehicle towards the changing center of gravity to maintain the vehicle in an upright direction;

a circuit board secured within the housing and a receiver in communication with the circuit board; and a remote control unit with a transmitter to send commands to the receiver, such that the circuit board can adjust a speed of the vehicle and adjust the means for pivoting the platform in response to said commands.

2. The vehicle of claim 1 wherein the means for pivoting the platform is a tilt mechanism secured between the housing and the platform.

3. The vehicle of claim 2, wherein said tilt mechanism includes a servo.

4. The vehicle of claim 3, wherein said servo is remotely controlled.

5. The vehicle of claim 1, wherein:

the wheel has two sides with a rim extending outwardly from each side; and the housing includes a plurality of bearing pairs, each bearing pair having a space defined therebetween to receive said rim defined on either side of the wheel, such that the wheel is rotatably secured within the housing.

6. The vehicle of claim 5, wherein the means for rotating said wheel includes a motor secured within the housing, the motor drives a gear which is meshed to an annular rack defined on the wheel.

7. The vehicle of claim 1, wherein said wheel has a flat outer surface such that the vehicle is able to be positioned in a substantially upright position when not moving.

8. The vehicle of claim 1, wherein said wheel has a rounded outer surface.

9. The vehicle of claim 1 wherein the wheel has an outer surface with a low surface friction such that the vehicle is able to turn at slower speeds.

10. A toy mono-wheel vehicle comprising:

a housing having a plurality of bearings;

a wheel having an annular rim extending outwardly from a side of said wheel, the rim being captured by said bearings such that said wheel is freely rotatable within the housing, the wheel having an outside portion for contact with a surface;

a means for rotating said wheel independently of said housing; and a mechanically operated tilt mechanism secured to an inner circumference defined by said housing, the tilt mechanism having a means to pivot it sideways relative to said housing, such that when the tilt mechanism pivots to a side, the center of gravity of the vehicle changes causing the vehicle to turn into the pivoting tilt mechanism, and wherein said means to pivot the tilt mechanism to a side of the housing includes a servo operably connecting the tilt mechanism to the housing.

11. The toy vehicle of claim 10 further comprising a circuit board to control the pivoting means and to control the rotating means.

12. The toy vehicle of claim 11 wherein the circuit board includes pre-programmed commands to control a degree of pivoting of the tilt mechanism and a speed of the rotating means.

13. The toy vehicle of claim 10 further comprising a remote control unit to send commands to the circuit board to control the pivoting means and to control the rotating means.

14. The toy vehicle of claim 10, wherein the outer portion of the wheel is flat such that the vehicle is able to stand in an upright position when not moving.

15. The toy vehicle of claim 10, wherein the outer portion of the wheel has a low surface friction.

16. The vehicle of claim 10, wherein the means for rotating said wheel independently of said housing includes:

a motor secured within the housing;

a rack positioned on the wheel; and a gear train driven by the motor and meshed to the rack.

17. A mono-wheel vehicle comprising:

a housing, a wheel having a center axis, the wheel being secured to the housing such that the wheel is capable of rotation about its center axis independently of said housing, the wheel having an outside portion for contact with a surface and an annular rack;

a motor secured to the housing and operably connected to the annular rack, such that when operating, the motor rotates the annular rack and drives the wheel, which when in contact with a surface is able to propel the vehicle across the surface, and wherein when said wheel is rotating, gyroscopic forces acting on the vehicle maintain said rotating wheel in a substantially upright position and traveling along the surface in a first direction;

a platform pivotally connected by a mechanically operated tilting means to an inner circumference defined by the housing, wherein the tilting of said platform causes a change in a center of gravity that causes the gyroscopic forces acting on the vehicle to turn the vehicle towards the changing center of gravity to maintain the vehicle in an upright direction;

a circuit board secured within the housing and a receiver in communication with the circuit board; and a remote control unit with a transmitter to send commands to the receiver, such that the circuit board can adjust a speed of the vehicle and adjust the mechanically operated tilting means for pivoting the platform in response to said commands.

18. The vehicle of claim 17, wherein:

said wheel further includes an annular rim extending outwardly therefrom and the annular rack is positioned on an inner circumference of the wheel, and said housing further includes a plurality of bearings defined to capture said rim, such that the wheel is rotatably secured within the housing.

19. The vehicle of claim 17 wherein the outside portion of the wheel is flat such that the vehicle can be positioned in a substantially upright position when not moving.

20. The vehicle of claim 17 wherein the outside portion of the wheel has a low surface friction.

21. A toy mono-wheel vehicle comprising:

a centerless mono-wheel;

a driving mechanism to rotate the wheel, wherein when the mono-wheel rotates at significant speeds, gyroscopic forces acting on the wheel maintain the wheel in a substantially upright position;

a mechanically operated steering mechanism to turn the vehicle; and a receiver to receive commands to control the steering mechanism and the driving mechanism.

22. The vehicle of claim 21 wherein the wheel includes an outside surface that is flat such that the vehicle is able to stand in a substantially upright position when the wheel is not rotating.

23. The vehicle of claim 21, wherein mechanically operated steering mechanism to turn the vehicle is a platform pivotably secured about the wheel, wherein when the platform is pivoted sideways the vehicle turn into the pivot as gyroscopic forces act on the vehicle to sustain the vehicle in a substantially upright position.

* * * * *